US008649693B2

(12) United States Patent
Mitsui

(10) Patent No.: US 8,649,693 B2
(45) Date of Patent: Feb. 11, 2014

(54) IMAGE FORMING APPARATUS

(75) Inventor: Shinji Mitsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 303 days.

(21) Appl. No.: 13/271,710

(22) Filed: Oct. 12, 2011

(65) Prior Publication Data

US 2012/0251134 A1 Oct. 4, 2012

(30) Foreign Application Priority Data

Mar. 30, 2011 (JP) ..... 2011-075844

(51) Int. Cl.
*G03G 15/08* (2006.01)
*G03G 15/00* (2006.01)

(52) U.S. Cl.
USPC ..... 399/27; 399/13

(58) Field of Classification Search
USPC ..... 399/13, 25, 27, 30
See application file for complete search history.

(56) References Cited

U.S. PATENT DOCUMENTS

| | | | | |
|---|---|---|---|---|
| 6,473,572 | B1 | 10/2002 | Uchiyama et al. | |
| 6,690,896 | B2 * | 2/2004 | Hanada et al. | 399/27 |
| 7,440,705 | B2 * | 10/2008 | Hatakeyama | 399/27 |
| 2009/0162078 | A1 | 6/2009 | Kojo | |

FOREIGN PATENT DOCUMENTS

| | | | |
|---|---|---|---|
| JP | A-2001-147633 | | 5/2001 |
| JP | 2003149931 | A * | 5/2003 |
| JP | A-2009-151147 | | 7/2009 |

* cited by examiner

*Primary Examiner* — Susan Lee
(74) *Attorney, Agent, or Firm* — Oliff PLC

(57) ABSTRACT

An image forming apparatus includes an image holding member, an exposing device, a developing device, a transfer device, a fixing device, a container mounting portion demountably mounted with a toner container, a toner supply unit supplying the toner to the developing device from the toner container, a first estimation unit estimating an amount of toner used on the basis of the image data, a second estimation unit estimating the amount of toner used on the basis of a toner supplying operation of the toner supply unit, and an emptiness determining unit determining emptiness of the toner container on the basis of only the amount of toner used estimated by the first estimation unit in a first state and both the amounts of toner used estimated by the first and second estimation units in a second state.

4 Claims, 10 Drawing Sheets

(FIG. 6 Continued)
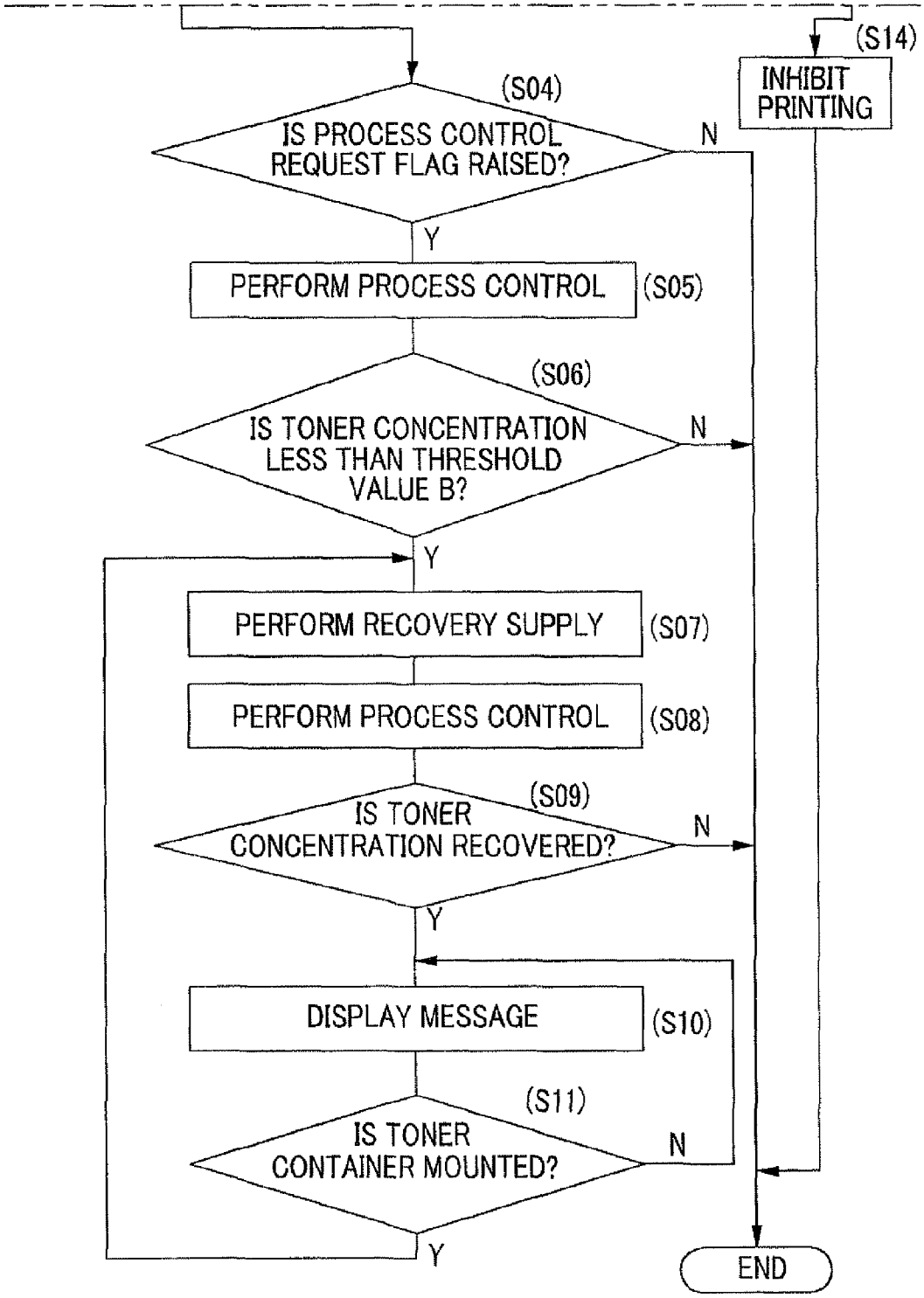

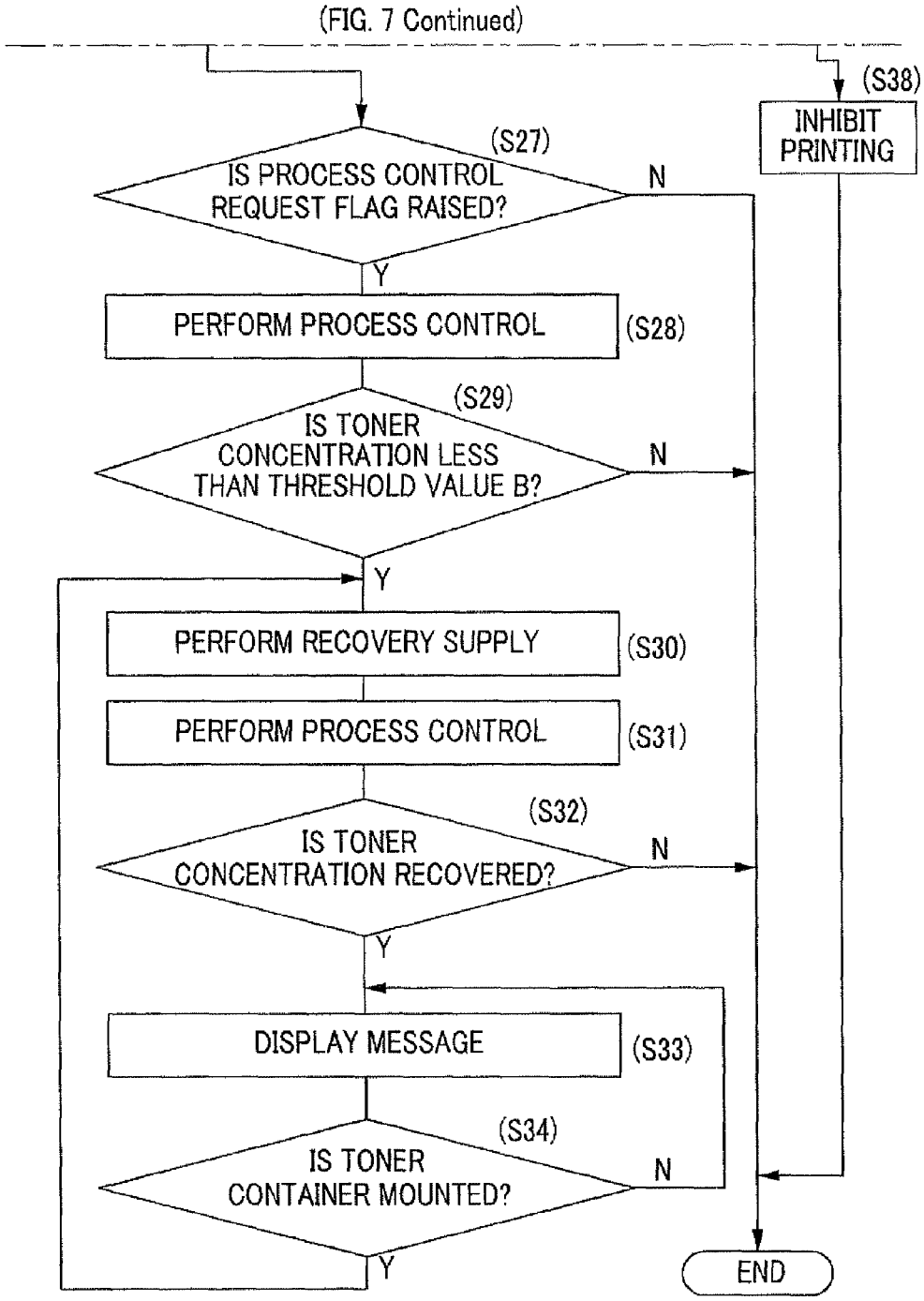
(FIG. 7 Continued)
(S38)
INHIBIT PRINTING
(S27)
IS PROCESS CONTROL REQUEST FLAG RAISED?
N
Y
PERFORM PROCESS CONTROL
(S28)
(S29)
IS TONER CONCENTRATION LESS THAN THRESHOLD VALUE B?
N
Y
PERFORM RECOVERY SUPPLY
(S30)
PERFORM PROCESS CONTROL
(S31)
(S32)
IS TONER CONCENTRATION RECOVERED?
N
Y
DISPLAY MESSAGE
(S33)
(S34)
IS TONER CONTAINER MOUNTED?
N
Y
END

IMAGE FORMING APPARATUS

CROSS-REFERENCE TO RELATED APPLICATIONS

This application is based on and claims priority under 35 USC 119 from Japanese Patent Application No. 2011-075844 filed Mar. 30, 2011.

BACKGROUND (i) Technical Field

The present invention relates to an image forming apparatus.

(ii) Related Art

Regarding image forming apparatuses, an image forming apparatus of a type which is demountably mounted with a toner container containing supply toner and which supplies toner to a developing device from the mounted toner container in time with the consumption of toner in the developing device is known. In such a type of image forming apparatus, it is necessary to detect the lifespan (emptiness) of the mounted toner container and to prompt a user to replace the toner container.

SUMMARY

According to an aspect of the invention, there is provided an image forming apparatus including: an image holding member that holds a latent image formed by exposure and that holds a toner image formed by development with toner; an exposing device that receives image data and that exposes the image holding member on the basis of the image data to form a latent image on the image holding member; a developing device that develops the latent image on the image holding member with toner to form a toner image on the image holding member; a transfer device that transfers the toner image on the image holding member to a recording medium; a fixing device that fixes the transferred toner image to the recording medium; a container mounting portion that is demountably mounted with a toner container containing toner; a toner supply unit that supplies the toner to the developing device from the toner container mounted on the container mounting portion; a first estimation unit that estimates an amount of toner used on the basis of the image data; a second estimation unit that estimates the amount of toner used on the basis of a toner supplying operation of the toner supply unit; and an emptiness determining unit that determines emptiness of the toner container mounted on the container mounting portion on the basis of only the amount of toner used estimated by the first estimation unit in a first state where it is unclear that the toner container is mounted on the container mounting portion and that determines the emptiness of the toner container mounted on the container mounting portion on the basis of both the amount of toner used estimated by the first estimation unit and the amount of toner used estimated by the second estimation unit in a second state where it is clear that the toner container is mounted on the container mounting portion.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described with reference to the accompanying drawings.

Figure 1:
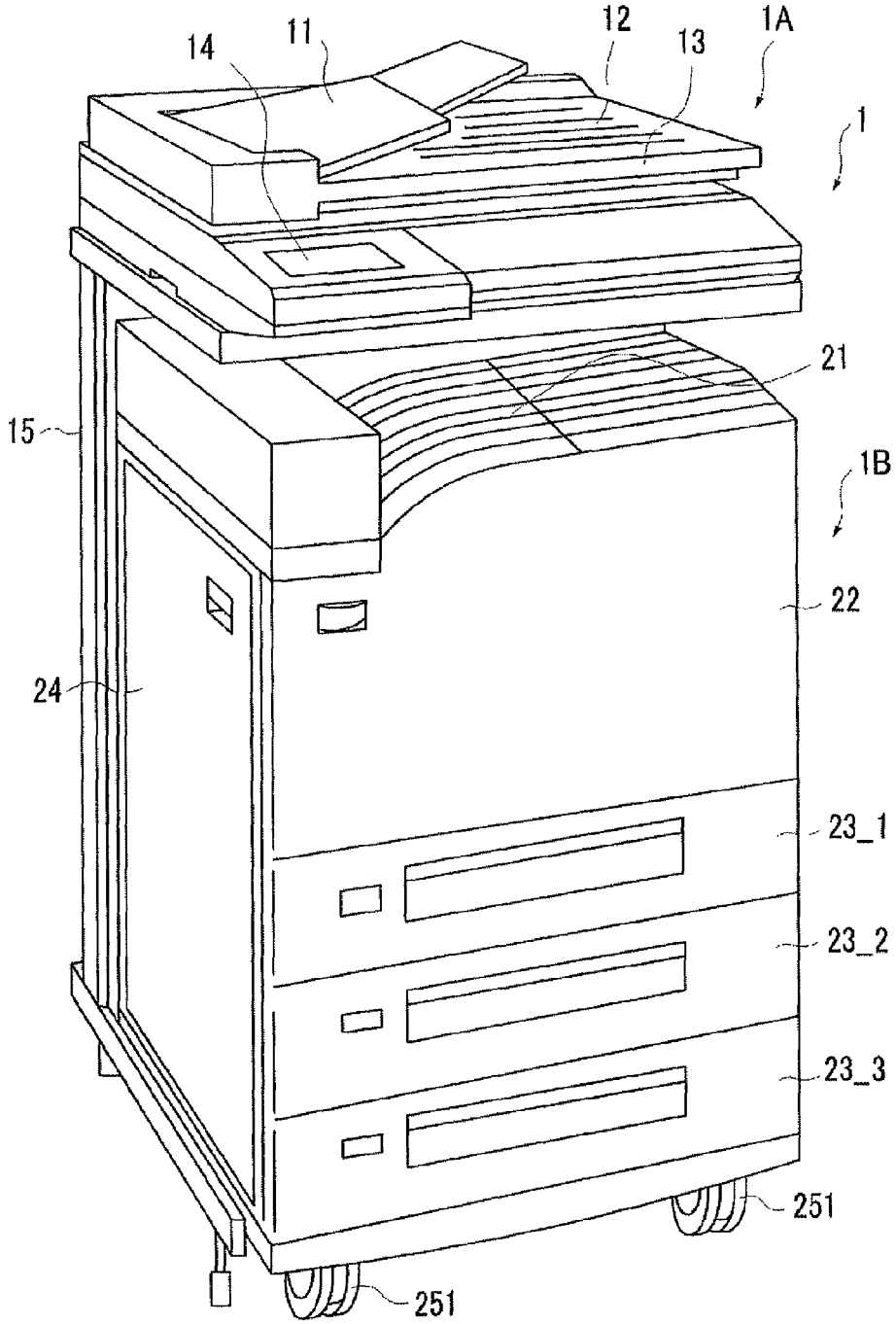
FIG. 1 is a perspective view illustrating the appearance of a copying machine as an example of an image forming apparatus according to an exemplary embodiment of the invention.

FIG. 1 is a perspective view illustrating the appearance of a copying machine as an example of an image forming apparatus.

The copying machine 1 includes a document reading section 1A and an image forming section 1B.

The document reading section 1A includes a document feed tray 11 on which documents are placed to overlap with each other. The documents placed on the document feed tray 11 are picked up sheet by sheet, letters or images recorded on the documents are read, and the documents are then discharged onto a document discharge tray 12.

The document reading section 1A includes a hinge extending horizontally on the deep side so as to together raise the document feed tray 11 and the document discharge tray 12 about the hinge and a document platen 13 (see FIG. 2) formed of transparent glass is disposed below. In the document reading section 1A, only a sheet of document may be put face-down on the document platen 13 instead of putting the documents on the document feed tray 11 and letters or images may be read from the document on the document platen 13.

A display operation unit 14 displaying various messages for a user and displaying various operation buttons so as to receive an operation such as instructions to read a document or to form an image from the user is disposed in the front of the document platen 13.

The document reading section 1A is supported by a support frame 15 as a whole.

The top surface of the image forming section 1B is provided with a discharge tray 21 onto which a sheet of paper having an image formed thereon is discharged. The front surface of the image forming section 1B is provided with a front cover 22 which is opened to replace components such as a toner container or to remove a jammed sheet of paper. Three drawer-type feed trays 23_1, 23_2, and 23_3 on which sheets of paper not having an image formed thereon are stacked are disposed below the front cover 22.

The left surface of the image forming section 1B is provided with a side cover 24 which is opened to remove a jammed sheet of paper.

The bottom of the image forming section 1B is provided with wheels 251 which may allow the image forming section 1B to move.

Figure 2:
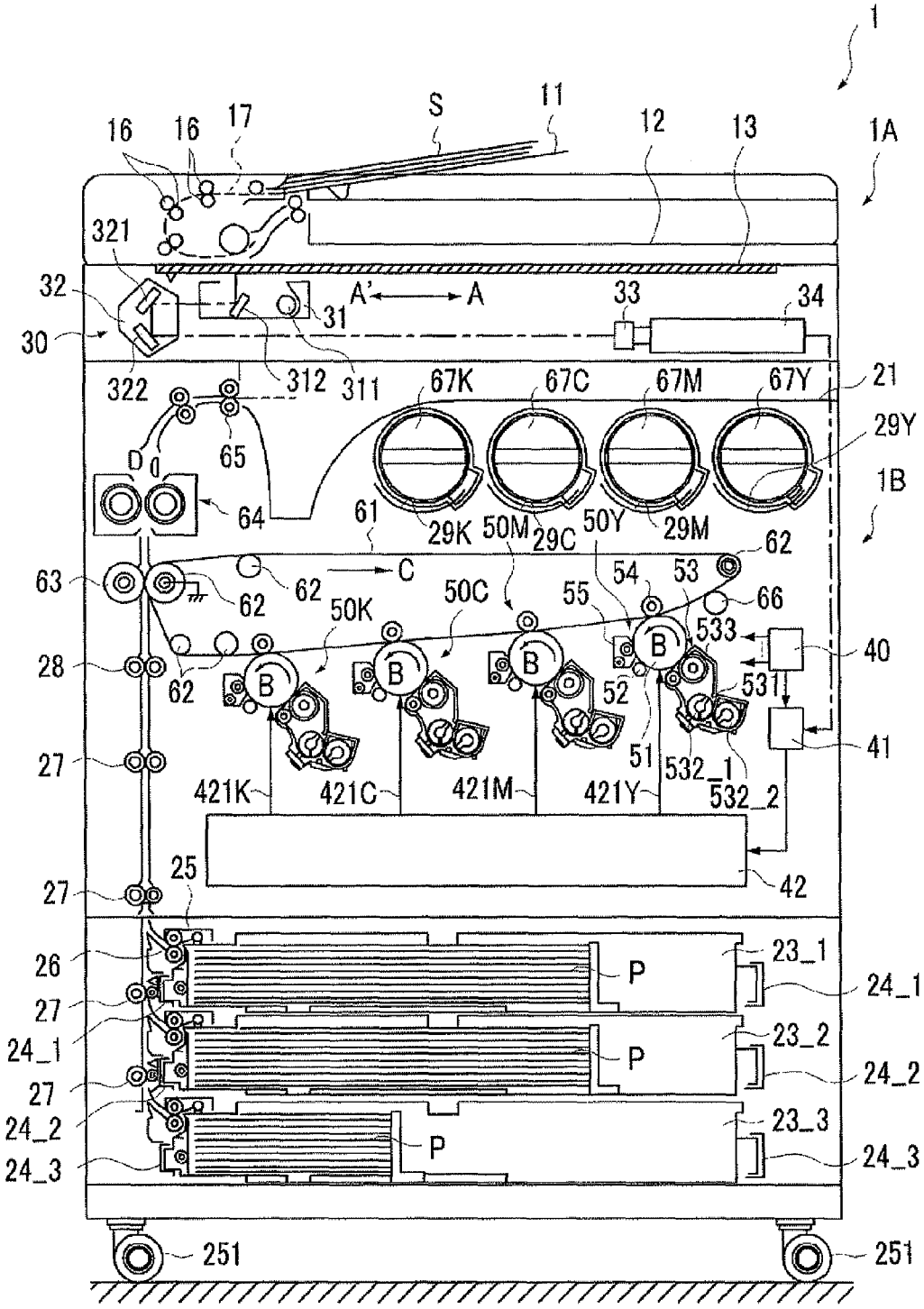
FIG. 2 is a diagram illustrating the internal configuration of the copying machine shown in FIG. 1.

FIG. 2 is a diagram illustrating the internal configuration of the copying machine of which the appearance is shown in FIG. 1.

A document reading optical system 30 is disposed below the document platen 13 formed of transparent glass. The document reading optical system 30 includes a first block 31 having a lamp 311 and a mirror 312, a second block 32 having two mirrors 321 and 322, and a photoelectric sensor 33 reading light indicating an image and generating an image signal.

The first block 31 and the second block 32 may move in the direction of arrow A-A' along the document platen 13 and is initially located at a position close to the left end shown in FIG. 2.

Documents S placed on the document feed tray 11 are picked up sheet by sheet and are transported over a transporting path 17 coming in contact with the document platen 13 by transport rollers 16. The document S is irradiated with light by the lamp 311 at the time of being transported over the document platen 13 in contact therewith, reflected light from the document S is reflected by the mirrors 312, 321, and 322 and is read by the photoelectric sensor 33 to generate an image signal indicating the letters or images recorded on the document S. The document S irradiated with light by the lamp 311 is further transported and discharged onto the document discharge tray 12.

When a document is placed on the document platen 13, the first block 31 and the second block 32 move in the direction of arrow A so as to keep constant the optical distance between the document reading position on the document platen 13 and the photoelectric sensor 33. In the meantime, the lamp 311 irradiates the document with light and the letters or images on the document are read and converted into an image signal by the photoelectric sensor 33.

The image signal acquired by the photoelectric sensor 33 is input to an image processing unit 34. The image signal acquired by the photoelectric sensor 33 is an image signal indicating colors of R (red), G (green), and B (blue). The image processing unit 34 converts the RGB image signal into image data including four colors of Y (yellow), M (magenta), C (cyan), and K (black) and temporarily stores the resultant image data. The image data is transmitted to an exposure controller 41 in time with the exposure for forming a latent image to be described later.

The image forming section 1B includes an exposing device 42. The image data of Y, M, C, and K is input to the exposing device 42 from the exposure controller 41 depending on the latent image type and exposing light beams 421Y, 421M, 421C, and 421K modulated on the basis of the image data of Y, M, C, and K are generated from the exposing device 42.

In FIG. 2, a main controller 40 is shown at a position adjacent to the exposure controller 41. The main controller 40 includes a micro computer and programs to be executed by the micro computer, and is connected to the exposure controller 41, the display operation unit 14 (see FIG. 1), the image processing unit 34, and various other power supply circuits and driving circuits not shown to control the entirety of the copying machine 1.

The above-mentioned three feed trays 23_1, 23_2, and 23_3 are supported by right and left guide rails 24_1, 24_2, and 24_3 and are received in the lower part of the image forming section 1B. Sheets of paper P are stacked in the feed trays 23_1, 23_2, and 23_3. The feed trays 23_1, 23_2, and 23_3 are guided and drawn out by the guide rails 24_1, 24_2, and 24_3 so as to supply sheets of paper P.

From the feed tray (for example, the feed tray 23_1) designated by the operation of the display operation unit 14 (see FIG. 1) or the like out of the three feed trays 23_1, 23_2, and 23_3, the sheets of paper P are picked up by a pickup roll 25 and are separated sheet by sheet by a separation roll 26, the separated sheet of paper P is transported upward by a transport roll 27, the subsequent transport time is adjusted by a register roll 28 and is then transported upward. The transport of a sheet of paper after the register roll 28 will be described later.

Four image forming units 50Y, 50M, 50C, and 50K forming toner images with color toner of Y, M, C, and K are disposed at the center of the image forming section 1B. Since the four image forming units 50Y, 50M, 50C, and 50K have the same configuration except that the colors of toner to be used are different from each other, only the configuration of the image forming unit 50Y will be representatively described herein.

The image forming unit 50Y includes a photosensitive member 51 rotating in a direction indicated by arrow B in FIG. 2 and a charging device 52, a developing device 53, and a cleaner 55 are disposed around the photosensitive member 51. A transfer device 54 is disposed at a position opposed to the photosensitive member 51 with an intermediate transfer belt 61 to be described later therebetween.

The photosensitive member 51 has a roll shape, holds electric charges thereon by charging, and discharges the electric charges by exposure to form and hold an electrostatic latent image on the surface thereof.

The charging device 52 charges the surface of the photosensitive member 51 to a certain charging potential.

The image forming section 1B includes the exposing device 42. The exposing device 42 receives an image signal from the exposure controller 41 and outputs exposing light beams 421Y, 421M, 421C, and 421K modulated on the basis of the received image signal. The photosensitive member 51 is charged by the charging device 52 and is irradiated with the exposing light beam 421Y by the exposing device 42, whereby an electrostatic latent image is formed on the surface of the photosensitive member 51.

After the electrostatic latent image is formed on the surface thereof by the irradiation with the exposing light beam 421Y, the photosensitive member 51 is developed by the developing device 53 and thus a toner image (a toner image with yellow (Y) toner in the image forming unit 50Y) is formed on the surface of the photosensitive member 51.

In a case 531 containing developer including toner and carriers therein, the developing device 53 includes two augers 532_1 and 532_2 agitating the developer and a developing roll 533 supplying the developer to a position opposed to the photosensitive member 51. At the time of developing the electrostatic latent image formed on the photosensitive member 51, a bias voltage is applied to the developing roll 533 and the toner of the developer is attached to the photosensitive member 51 along the electrostatic latent image formed on the photosensitive member 51 by the operation of the bias voltage, whereby a toner image is formed.

The toner image formed on the photosensitive member 51 by the development of the developing device 53 is transferred to an intermediate transfer belt 61 by the operation of the transfer device 54.

The toner remaining on the photosensitive member 51 after the transferring is removed from the photosensitive member 51 by the cleaner 55.

The intermediate transfer belt 61 is an endless belt suspended on plural rolls 62 and circulating in the direction of arrow C.

The color toner images formed by the image forming units 50Y, 50M, 50C, and 50K are sequentially transferred to the intermediate transfer belt 61 to overlap with each other and are transported to a secondary transfer position at which the transfer device 63 is disposed. In synchronization with this transport, the sheet of paper transported to the register roll 28 is transported to the secondary transfer position and the toner images on the intermediate transfer belt 61 are transported to the transported sheet of paper by the operation of the transfer device 63. The sheet of paper to which the toner images have been transferred is further transported and the toner images on the sheet of paper are fixed to the sheet of paper by the pressing and heating operations of the fixing device 64, whereby an image including the fixed toner images are formed on the sheet of paper. The sheet of paper having the image formed thereon is further transported and discharged to the discharge tray 21 by the discharge roller 65.

The intermediate transfer belt 61 of which the toner images are transferred to the sheet of paper by the transfer device 63 further circulates and the toner remaining on the surface thereof is removed from the intermediate transfer belt 61 by the cleaner 66.

In the image forming section 1B, container mounting portions 29Y, 29M, 29C, and 29K are disposed above the intermediate transfer belt 61. Toner containers 67Y, 67M, 67C, and 67K containing color toner of yellow (Y), magenta (M), cyan (C), and black (K) are mounted on the container mounting portions 29Y, 29M, 29C, and 29K. The color toner contained in the toner containers 67Y, 67M, 67C, and 67K is supplied to the developing devices 53 depending on the amounts of toner consumed in the corresponding developing devices 53.

In the image forming section 1B, with various events as a trigger such as an event where an image forming operation is performed on a predetermined number of sheets of paper, an event where the temperature and humidity environment varies, and an event where any component is replaced, "process control" is performed. In the process control, a uniform image (toner patch) with a predetermined image density is formed, the density of the toner patch is measured by the use of a detector not shown, the measured density is compared with a reference density, and various factors are adjusted so that the density of the toner patch is equal to the reference density. Examples of various factors include a variation in image density on image data, an amount of toner supplied to the developing device from the toner container, an amount of electric charges charged by the charging device, an exposing light intensity from the exposing device, and a developing bias voltage in the developing device. The temporal variation of the image density is corrected through the use of the process control and an image with a uniform density is formed. When an event for which the process control should be performed occurs, it may not be said to perform the process control at once due to the performing of a printing operation and the like. Accordingly, a process control request flag is raised, the flag is referred to when the process control may be performed, and the process control is performed when the flag is raised.

Figure 3:
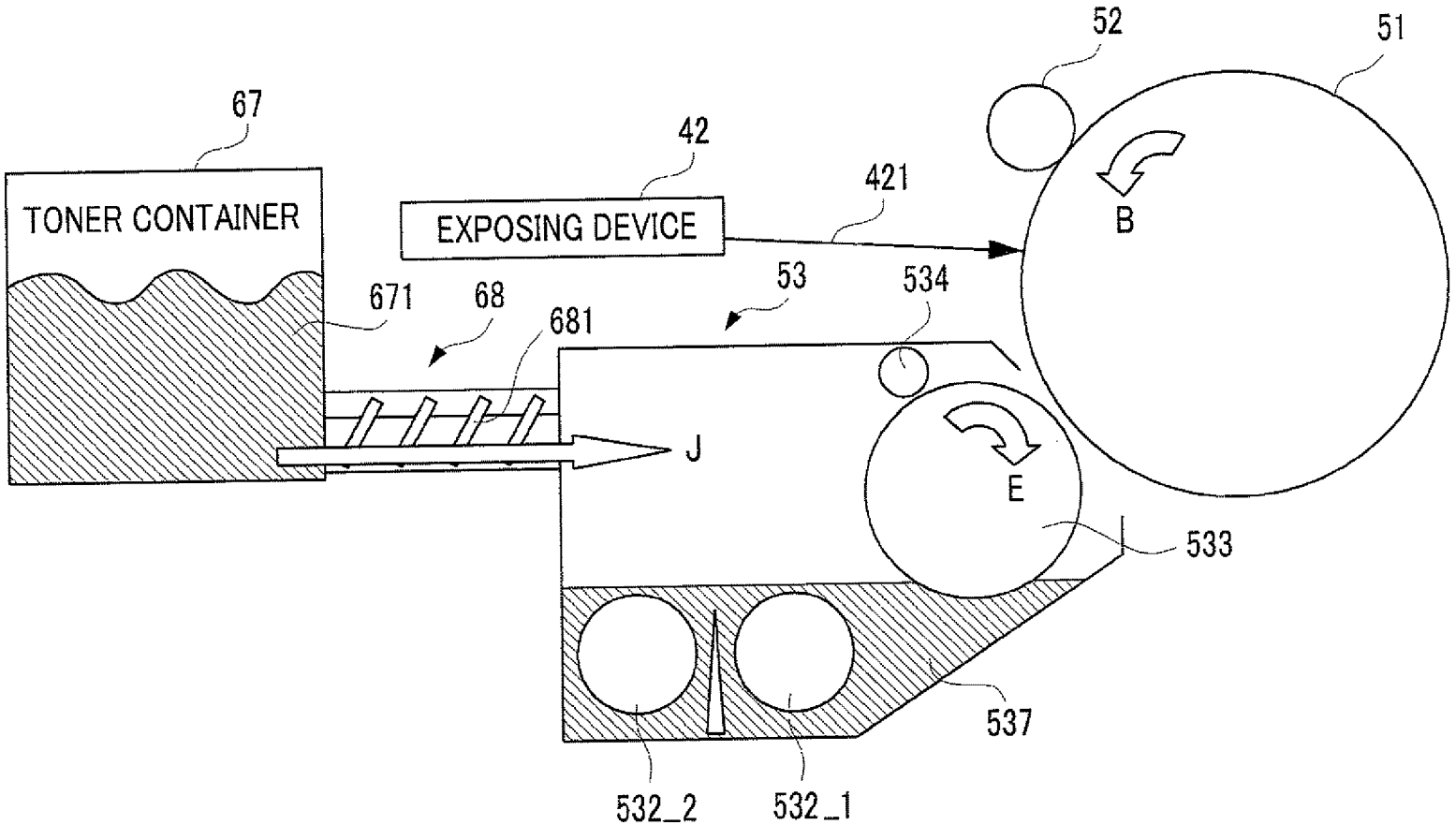
FIG. 3 is a sectional view schematically illustrating a toner container and a developing device.
Figure 4:
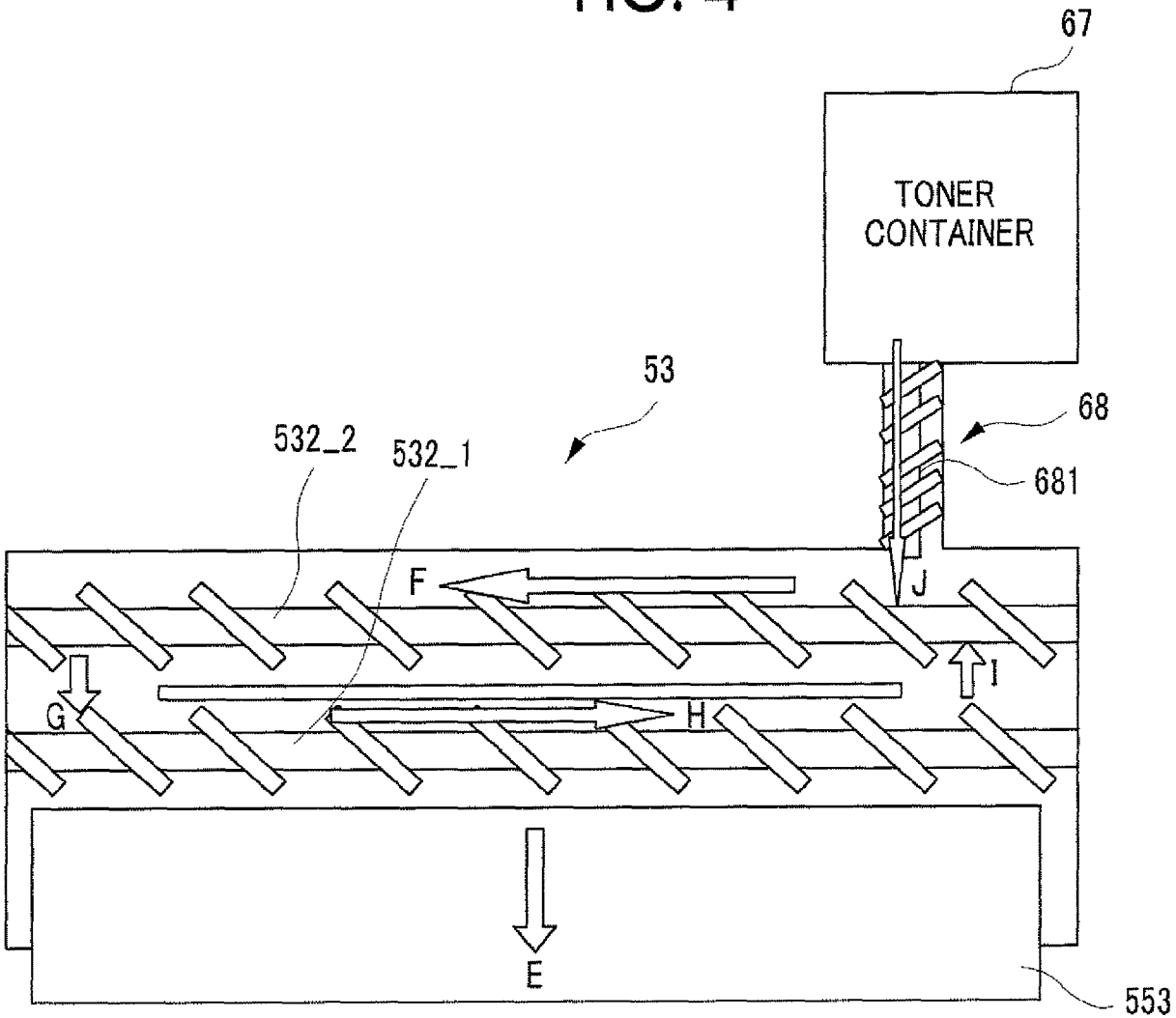
FIG. 4 is a sectional view schematically illustrating the toner container and the developing device.

FIGS. 3 and 4 are sectional views illustrating a toner container and a developing device. FIG. 3 is a schematic sectional view as seen from the side and FIG. 4 is a schematic sectional view as seen from the upside.

Here, only one system is representatively shown and the elements are referenced by reference numerals not having Y, M, C, and K attached thereto.

A developer 537 (see FIG. 3) including toner and carriers is contained in the developing device 53 and is agitated by two augers 532_1 and 532_2 while circulating in the direction indicated by arrows F, G, H, and I shown in FIG. 4. The developer 537 is held by the developing roll 533 rotating in the direction indicated by arrow E, the thickness thereof is restricted by a thickness restricting member 534, and the developer is supplied to a developing position opposed to the photosensitive member 51. On the other hand, the photosensitive member 51 rotates in the direction indicated by arrow B, is charged by the charging device 52, and is irradiated with exposing light by the exposing device 42 to form an electrostatic latent image thereon. The electrostatic latent image is developed with the toner of the developer supplied by the developing roll 533 to form a toner image on the photosensitive member 51. The post process on the toner image formed on the photosensitive member 51 has been described above with reference to FIG. 2 and is not repeated herein.

When the toner of the developer 537 in the developing device 53 is consumed in this way, the toner of the developer 537 is insufficient. Then, an auger 681 disposed in a toner supplying path 68 rotates and supply toner 671 contained in the toner container 67 is supplied along the toner supplying path 68 in the direction indicated by arrow J and is supplied to the inside of the developing device 53. The toner supplied to the inside of the developing device 53 is agitated and mixed with carriers by the two augers 532_1 and 532_2 while circulating along arrows F, G, H, and I shown in FIG. 4.

Figure 5:
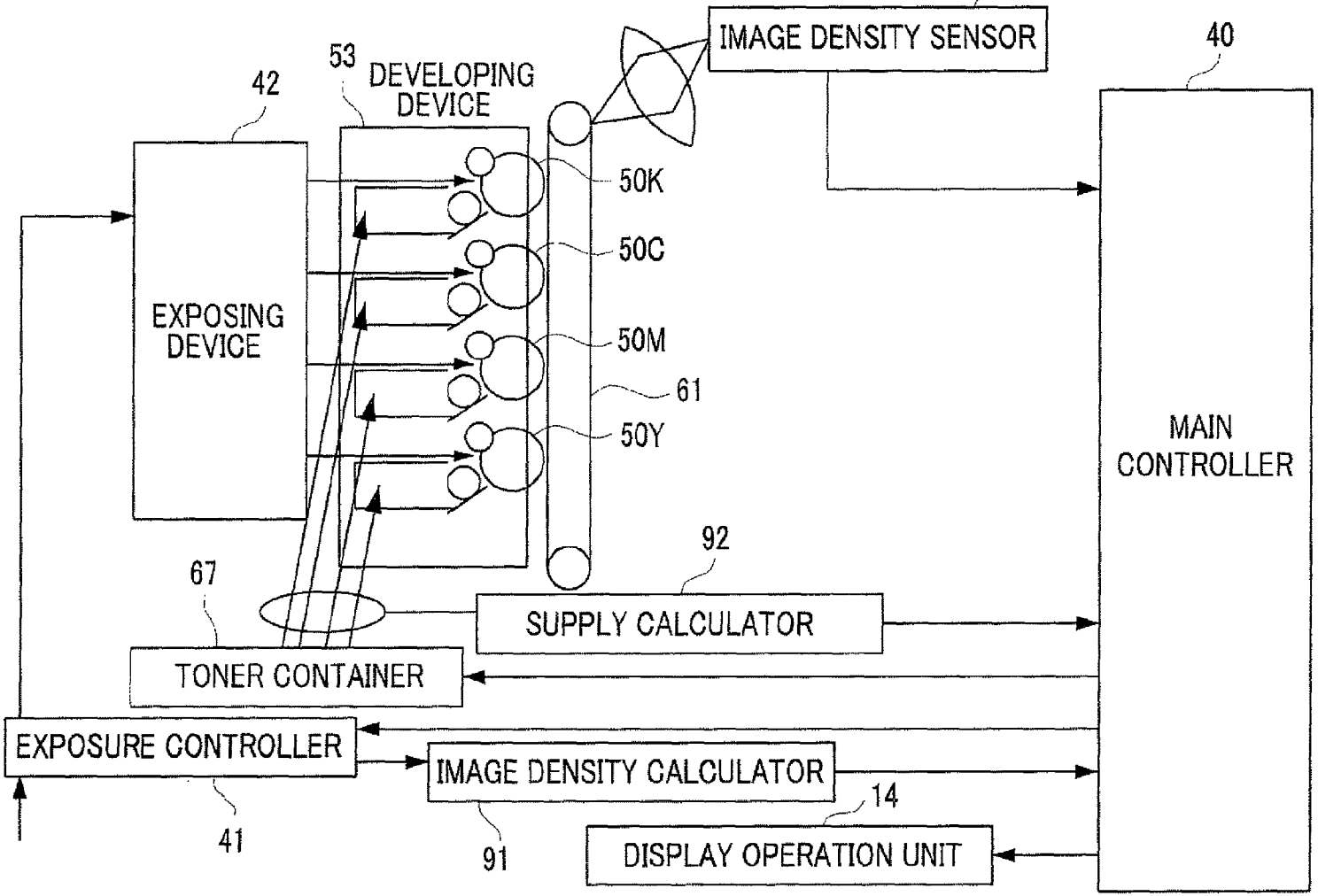
FIG. 5 is a block diagram illustrating a control system according to the exemplary embodiment.

FIG. 5 is a block diagram illustrating a control system according to this exemplary embodiment. Only elements required for explaining the features of this exemplary embodiment are shown in FIG. 5.

The main controller 40, the display operation unit 14, the exposure controller 41, the exposing device 42, the developing device 53, the toner container 67, the photosensitive members 51Y, 51M, 51C, and 51K, and the intermediate transfer belt 61, which are shown in FIG. 1 or 2, are shown in FIG. 5. In FIG. 5, four developing devices shown in FIG. 2 are shown as the developing device 53 and four toner containers shown in FIG. 2 are shown as the toner container 67. The elements shown in FIG. 1 or 2 have been described except for communication between the toner container 67 and the main controller 40, thus are not repeatedly described, and only the communication is described herein.

The toner container 67 is mounted with a nonvolatile memory (not shown) for each of the toner containers 67Y, 67M, 670, and 67K of Y, M, C, and K (see FIG. 2). The main controller 40 communicates with the nonvolatile memories mounted on the toner containers 67 and detects the presence of a container through the use of the communication. The main controller reads the type or the use history of the corresponding toner container from the nonvolatile memory or writes a new use history thereto. However, in the image forming section 1B (see FIGS. 1 and 2) according to this exemplary embodiment, toner containers not mounted with a nonvolatile memory are also used as color toner containers of Y, M, C, and K which are first mounted thereon. Details thereof will be described later.

The memory mounted on the toner container is not limited to the nonvolatile memory, but a volatile memory to which non-volatility is given by a backup battery or the like may be used.

An image density calculator 91, a supply calculator 92, and an image density sensor 93 are shown in FIG. 5.

The image density calculator 91 calculates image densities of Y, M, C, and K on the basis of image data transmitted to the exposure controller 41 from the image processing unit 34 shown in FIG. 2. That is, in the image forming section 1B shown in FIGS. 1 and 2, an image of which the gradation is indicated by the density of pixels to which the toner is attached is formed, and the number of pixels to which the toner is attached for each image is calculated for each color of Y, M, C, and K on the basis of the image data by the image density calculator 91. The information of the calculated number of pixels is transmitted to the main controller 40 and the main controller 40 calculates the cumulative number of pixels which is the accumulated value of the numbers of pixels created up to now for each color of Y, M, C, and K.

The supply calculator 92 calculates an amount of toner supplied to the developing device 53 from the toner container 67. The amount of toner supplied is calculated on the basis of the number of rotations of the auger 681 disposed in the toner supplying path 68 shown in FIGS. 3 and 4 and thus may be different from the actual amount of toner supplied. For example, the actual amount of toner supplied varies depending on the environmental temperature and humidity and the actual amount of toner supplied varies when the toner container 67 is fully filled with the supply toner and when the toner container 67 is close to the emptiness. The information of the amount of toner supplied calculated by the supply calculator 92 is transmitted to the main controller 40 and the main controller 40 calculates a cumulative calculated supply value which is the accumulated value of the amounts of toner supplied. Here, the calculating of the amount of toner supplied is performed for each color toner of Y, M, C, and K by the supply calculator 92, similarly to the calculation of the number of pixels in the image density calculator 91, and the main controller 40 calculates the cumulative calculated supply value for each color toner.

The image density sensor 93 senses the density of each toner patch formed through the above-mentioned process control by the color toner of Y, M, C, and K. The sensing result of the density of the toner patch is transmitted to the main controller 40.

An emptiness determining process, which is performed by the main controller 40, of determining whether a toner container is empty will be described on the basis of the above-mentioned configuration.

Figure 6:
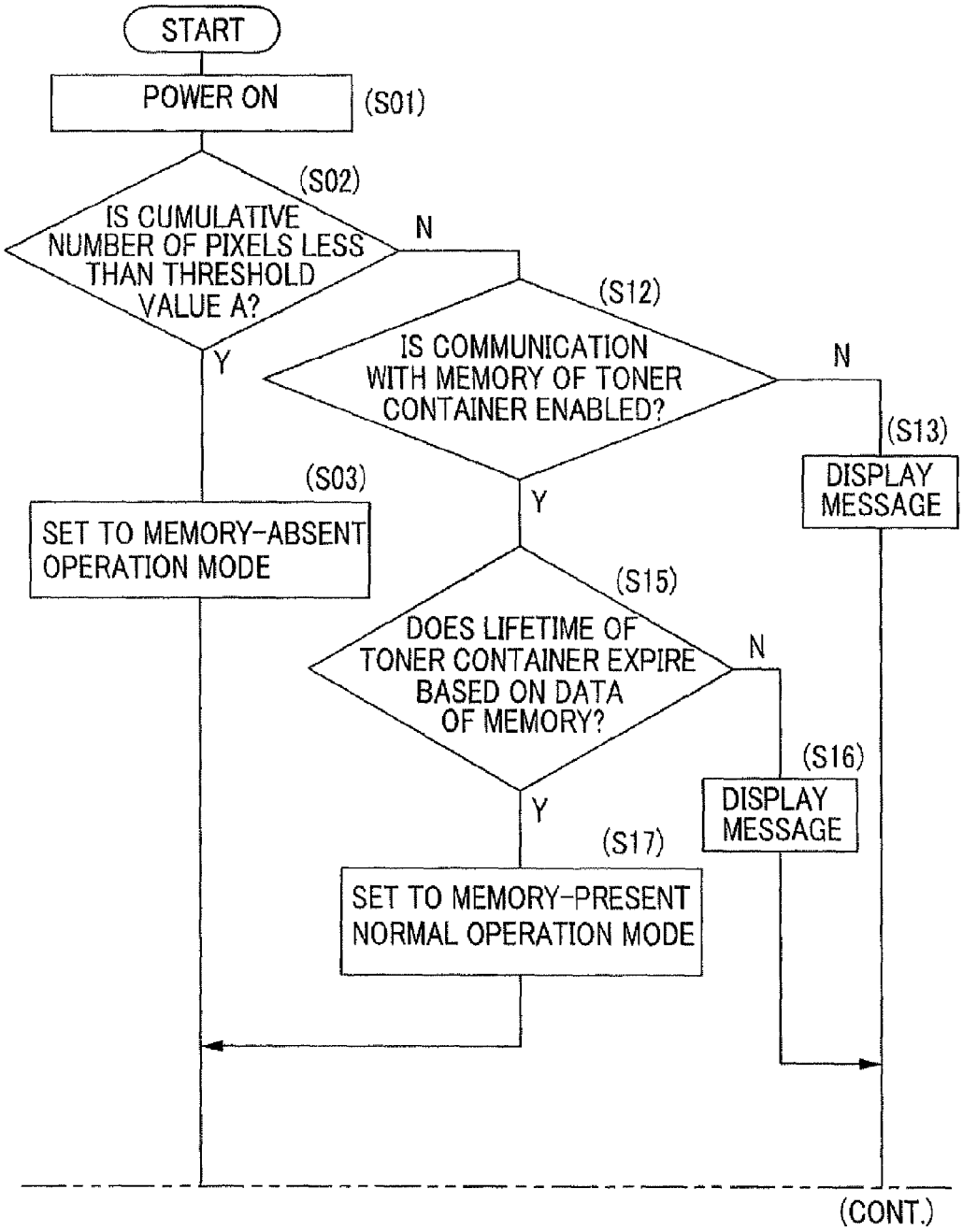
FIG. 6 is a flowchart illustrating an emptiness determining process which is performed by a main controller at the time of turning on the copying machine shown in FIG. 1.

FIG. 6 is a flowchart illustrating the emptiness determining process performed by the main controller at the time of turning on the copying machine shown in FIG. 1.

When the copying machine 1 shown in FIGS. 1 and 2 are turned (step S01), it is determined with reference to the cumulative number of pixels from the time point of starting use of a new product whether the cumulative number of pixels is equal to or less than a threshold value A (step S02). The cumulative number of pixels is a cumulative value, which is calculated by the main controller 40, of the amounts of toner used for each color of Y, M, C, and K for each image calculated on the basis of the image data by the image density calculator 91 shown in FIG. 5 and sequentially updated in step S25 of FIG. 7.

As described above, the copying machine 1 according to this exemplary embodiment permits use of toner containers not mounted with a nonvolatile memory only for the toner containers of Y, M, C, and K which are first used as a new product. That is, since the toner containers to be first used are provided to a user in a state where they are mounted on the body of the copying machine 1 shown in FIG. 1, it is a scheme for lowering the cost of the entirety of the copying machine 1 and the toner containers bundled therewith. When a first toner container is empty and is replaced with a new toner container, only a toner container having a nonvolatile memory attached thereto may be used. Here, the first toner container bundled into the copying machine 1 is referred to as a "bundled toner" and the toner container having a nonvolatile memory attached thereto is referred to as a "memory-attached toner container".

The threshold value A of step S02 in the flowchart shown in FIG. 6 is a threshold value used to determine whether the lifespan of a bundled toner container expires (whether it is empty).

After a bundled toner container is empty and is replaced with a memory-attached toner container, the lifespan of the memory-attached toner container is determined on the basis of the cumulative number of pixels and a cumulative calculated supply value which is the cumulative value of the amounts of toner supplied calculated by the supply calculator 92 shown in FIG. 5, as described later. On the contrary, the lifespan of the bundled toner container is determined on the basis of only the cumulative number of pixels out of the cumulative number of pixels and the cumulative calculated supply value.

In the copying machine according to this exemplary embodiment, when a memory-attached toner container is mounted thereon, it is possible to confirm that the toner container is surely mounted by communicating with the nonvolatile memory attached to the memory-attached toner container. On the contrary, it is permitted the copying machine according to this exemplary embodiment to use a bundled toner container. Accordingly, even when the communication with a nonvolatile memory is disabled, that is, even when it is not clear that a toner container is actually mounted, the copying machine may perform its copying operation. That is, even when a toner container is not mounted, or when a toner container is demounted for some reasons after it is once mounted, a printing operation may be performed. In this case, when the amount of toner of the developer remaining in the developing device becomes smaller, a toner supplying operation from a toner container to be mounted thereon is performed. That is, as described above, the supply calculator 92 shown in FIG. 5 calculates the amount of toner supplied on the basis of the number of rotations of the auger 681 in the toner supplying path 68 shown in FIGS. 3 and 4. Accordingly, even when a toner container is not mounted and toner is not actually supplied, the amount of toner supplied calculated by the supply calculator 92 is added. Therefore, when a printing operation is permitted in a state where it is not clear that a toner container is mounted, the reliability of the calculated amount of toner supplied is greatly reduced. On the contrary, the cumulative number of pixels is based on image signals and includes an error from the actual amount of toner used, but the possibility to instruct the printing operation with a normal image forming operation not performed is low and the higher reliability than that of the cumulative calculated supply value is maintained even when the bundled toner container is used.

This is the reason for determining the lifespan of the bundled toner container on the basis of only the cumulative number of pixels in this exemplary embodiment.

The process flow will be subsequently described with reference to the flowchart shown in FIG. 6.

When it is determined in step S02 of the flowchart shown in FIG. 6 that the cumulative number of pixels is less than the threshold value A, that is, when the lifespan of the bundled toner container does not expire, a "memory-absent operation mode" is set (step S03). The "memory-absent operation mode" is a mode in which a printing operation is performed even when the bundled toner container, that is, a toner container not having a nonvolatile memory attached thereto, is mounted. In this mode, the apparatus does not confirm that a toner container is actually mounted and performs a printing operation even when the toner container is not mounted. Here, the determination in step S02 on whether the cumulative number of pixels is less than the threshold value A and the process of setting the memory-absent operation mode are performed for each color of Y, M, C, and K.

In step S04, it is determined whether a process control request flag is raised. When it is determined that the process control request flag is not raised, the process flow shown in FIG. 6 when the power source is turned on is ended as it were, that is, in the state where the printing operation in the memory-absent operation mode is permitted.

When it is determined in step S04 that the process control request flag is raised, the process control is performed (step S05). The density of the toner patch formed in the process control is sensed by the image density sensor 93 shown in FIG. 5 and it is determined whether the density of the toner patch is less than a threshold value B (step S06). The threshold value B is a threshold value used to determine whether the toner concentration (the ratio of the toner to the carriers) of the developer in the developing device is excessively lowered and the toner concentration should be recovered. When it is determined in step S06 that the toner concentration is not less than the threshold value B, the process flow shown in FIG. 6 is ended. Here, the process control itself is simultaneously performed on the colors of Y, M, C, and K, but the determination (step S06) on whether the toner concentration is less than the threshold value B or the processes subsequent thereto such as a recovery supply operation (step S07) described below are performed for each developing device or each toner container corresponding to the color toner of the Y, M, C, and K.

When it is determined in step S06 that the toner concentration is less than the threshold value B, the recovery supply operation is performed in step S07. That is, a supplying operation of supplying toner to the developing device from the toner container to recover the toner concentration of the developer in the developing device is performed herein. Specifically, the process of causing the auger 681 in the toner supplying path 68 shown in FIGS. 3 and 4 to rotate is performed herein. Thereafter, the process control is performed again (step S08) and it is determined whether the toner concentration is recovered (step S09). When the toner concentration is recovered, the process flow shown in FIG. 6 is ended. The toner supplying operation is not performed only at the time of performing the process control. That is, the amount of toner used is normally estimated and the toner supplying operation is performed slightly depending on the amount of toner used. When the toner concentration is less than the threshold value B (step S06), the recovery supply operation (step S07) is additionally performed. The recovery supply operation is performed within a normal operation range, but is performed in the following cases in terms of the lifespan of a toner container of interest in this exemplary embodiment. That is, examples thereof include a case where the operation is performed with a toner container not mounted in a memory-absent operation mode (see step S03) and a case where a bundled toner container is empty even when the bundled toner container is mounted but the cumulative number of pixels is less than the threshold value A for some reasons (see step S02). Alternatively, even when the normal operation mode in which a memory-attached toner container is mounted is set (see step S17 to be described later) and it is determined on the basis of data stored in the nonvolatile memory that the lifespan does not expire but the memory-attached toner container having the nonvolatile memory attached thereto is empty for some reasons, the process of step S07 and the processes subsequent thereto are performed. That is, the process of step S07 and the processes subsequent thereto are processes for guaranteeing safety when an abnormal case occurs in terms of the lifespan of the toner container.

When it is determined in step S09 that the toner concentration is not recovered, it means that the toner container is not mounted or that the attached toner container is actually empty even when it is determined that the lifespan thereof does not expire. Accordingly, a message indicating this state is displayed on the display operation unit 14 (see FIGS. 1 and 5) (step S10). Here, the toner container may not be mounted in the memory-absent operation mode, but a message of "Lifespan of Toner Cartridge Expires" may be representatively displayed or a message indicating that the lifespan of the toner container expires or that the toner container is not mounted may be displayed.

Thereafter, when it is determined that a toner container is mounted (step S11), the recovery supply operation is performed again (step S07). Here, the determination of step S11 on whether the toner container is mounted is performed by performing an operation required for mounting or replacing the toner container, for example, sensing an opening and shutting operation of the front cover 22 shown in FIG. 1 or the like in the memory-absent operation mode (see step S03). Accordingly, in the memory-absent operation mode, it is not surely confirmed that the toner container is replaced. On the other hand, in the normal operation mode (step S17), it is tried to communicate with a nonvolatile memory attached to the memory-attached toner container to which the nonvolatile memory is surely attached with the opening and shutting of the front cover 22 and it is determined that the toner container is mounted on the basis of the enabling of the communication. That is, in the normal operation mode, it may be confirmed that the toner container is mounted.

The case where it is determined in step S02 that the cumulative number of pixels is not less than the threshold value A will be described below. In this case, in step S12, it is tried to communicate with the nonvolatile memory of the toner container and it is determined whether the communication is enabled. When it is determined that the communication is not enabled, a message is displayed (step S13). The typical case where it is determined in step S12 that the communication is not enabled is a case where it is determined that the lifespan of a bundled toner container expires because the bundled toner container is used and the cumulative number of pixels reaches the threshold value A. Accordingly, in step S13, a message urging a user to replace the toner container is displayed. When the message is displayed in step S13, the printing operation is temporarily inhibited (step S14). When the toner container is replaced, a process of restarting the printing operation not shown is performed and the printing operation is permitted again. The inhibition or restart of the printing operation is a process simultaneously performed on all the colors of Y, M, C, and K.

When it is determined in step S12 that the communication with the memory of the toner container is enabled, it is confirmed that the memory-attached toner container is mounted and it is then determined whether the lifespan of the toner container expires on the basis of the data stored in the memory of the toner container (step S15). When it is determined that the lifespan of the toner container expires, the message urging a user to replace the toner container is displayed in step S16 and the printing operation is further inhibited (step S14).

Here, the memory-attached toner container is mounted. Accordingly, when it is determined in step S15 that the lifespan of the toner container does not expire, a normal operation mode where the lifespan of the toner container is determined while updating the record of the nonvolatile memory attached to the toner container is set (step S17) and the process of step S04 is performed. The algorithm of determining the lifespan of the toner container in the normal operation mode will be described with reference to steps S35 and S36 of the flowchart shown in FIG. 7 and FIG. 8.

Figure 7:
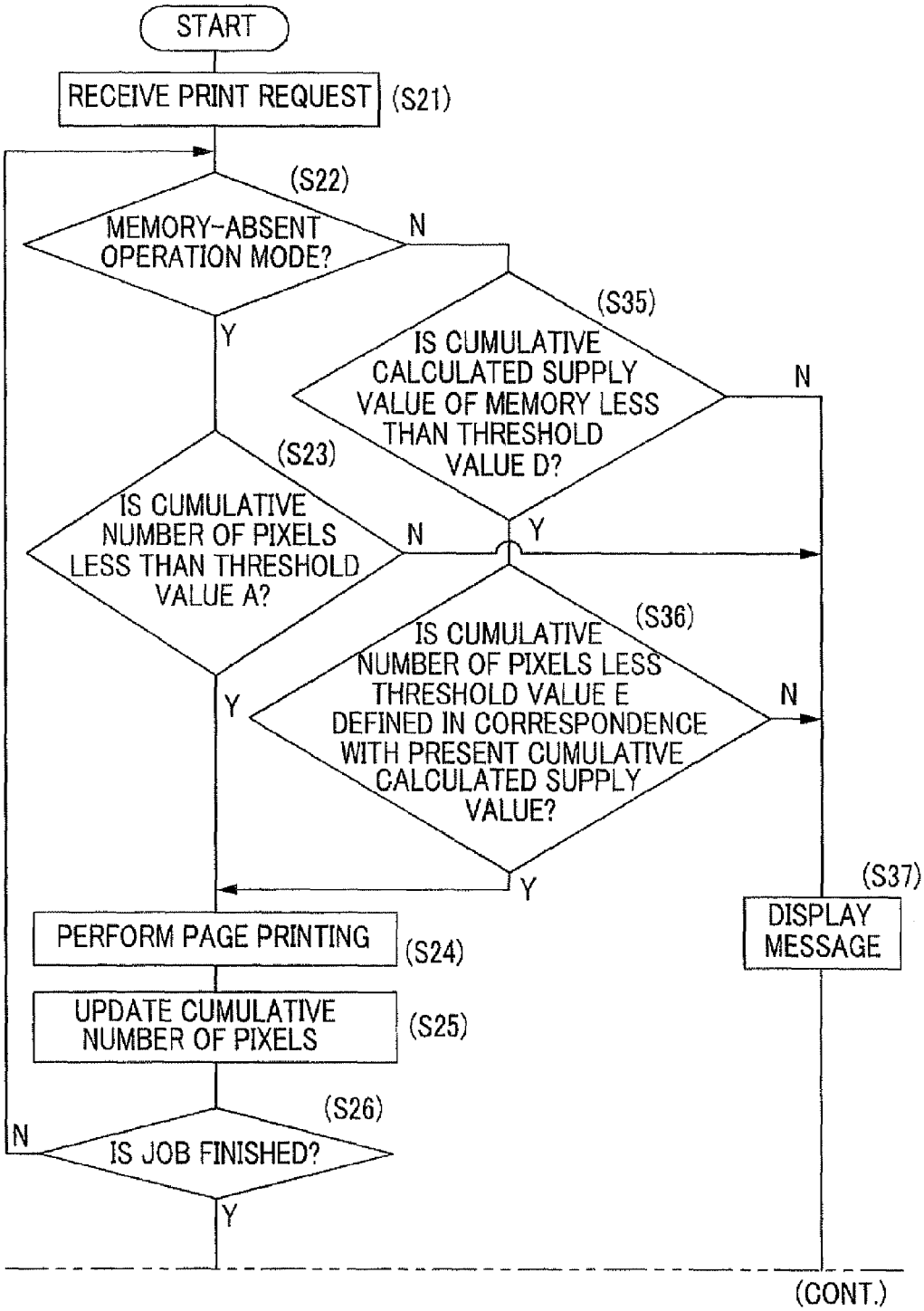
FIG. 7 is a flowchart illustrating the emptiness determining process which is performed when a print request is given.

FIG. 7 is a flowchart illustrating an emptiness determining process performed in response to a print request. The process flow shown in FIG. 7 is also performed for each developing device or each toner container corresponding to the color toner of Y, M, C, and K, except for a page printing process (step S24), a process control performing process (steps S28 and S31), and a print inhibiting process (step S38).

When the image forming section 1B shown in FIGS. 1 and 2 receives a print request (step S21), it is firstly determined whether the memory-absent operation mode (see step S03 of FIG. 6) or a normal operation mode (see S17 of FIG. 6) is set presently.

When it is determined that the memory-absent operation mode is set, it is then determined whether the cumulative number of pixels is less than the threshold value A (step S23). When it is determined that the cumulative number of pixels is not less than the threshold value A, the message urging a user to replace the toner container is displayed in step S37 and the printing operation is inhibited (step S38). When the toner container is replaced, the process of restarting the printing operation not shown is performed and the printing operation is permitted again.

When it is determined in step S23 that the cumulative number of pixels is less than the threshold value A, a printing operation corresponding to one page is performed (step S24) and the cumulative number of pixels is updated by one page (step S25).

The cumulative calculated supply value is updated whenever the toner supplying operation is performed, independently of the process flow shown in the flowchart in FIG. 7.

It is determined whether a job including one page subjected to this printing operation and including one or plural pages of prints performed in response to a print request is finished (step S26). When it is determined that the job is not finished, the process of step S22 and the processes subsequent thereto are repeatedly performed. When it is determined in step S26 that the job is finished, the process of step S27 and the processes subsequent thereto are performed. The processes of steps S27 to S34 are the same as the processes of steps S04 to S11 in the flowchart shown in FIG. 6 and thus the description will not be repeated.

When it is determined in step S22 that the memory-absent operation mode is not set, that is, the normal operation mode is set (see step S17 of FIG. 6), the process of step S35 is performed. In step S35 and step S36 subsequent thereto, it is determined whether the lifespan of the memory-attached toner container expires.

Figure 8:
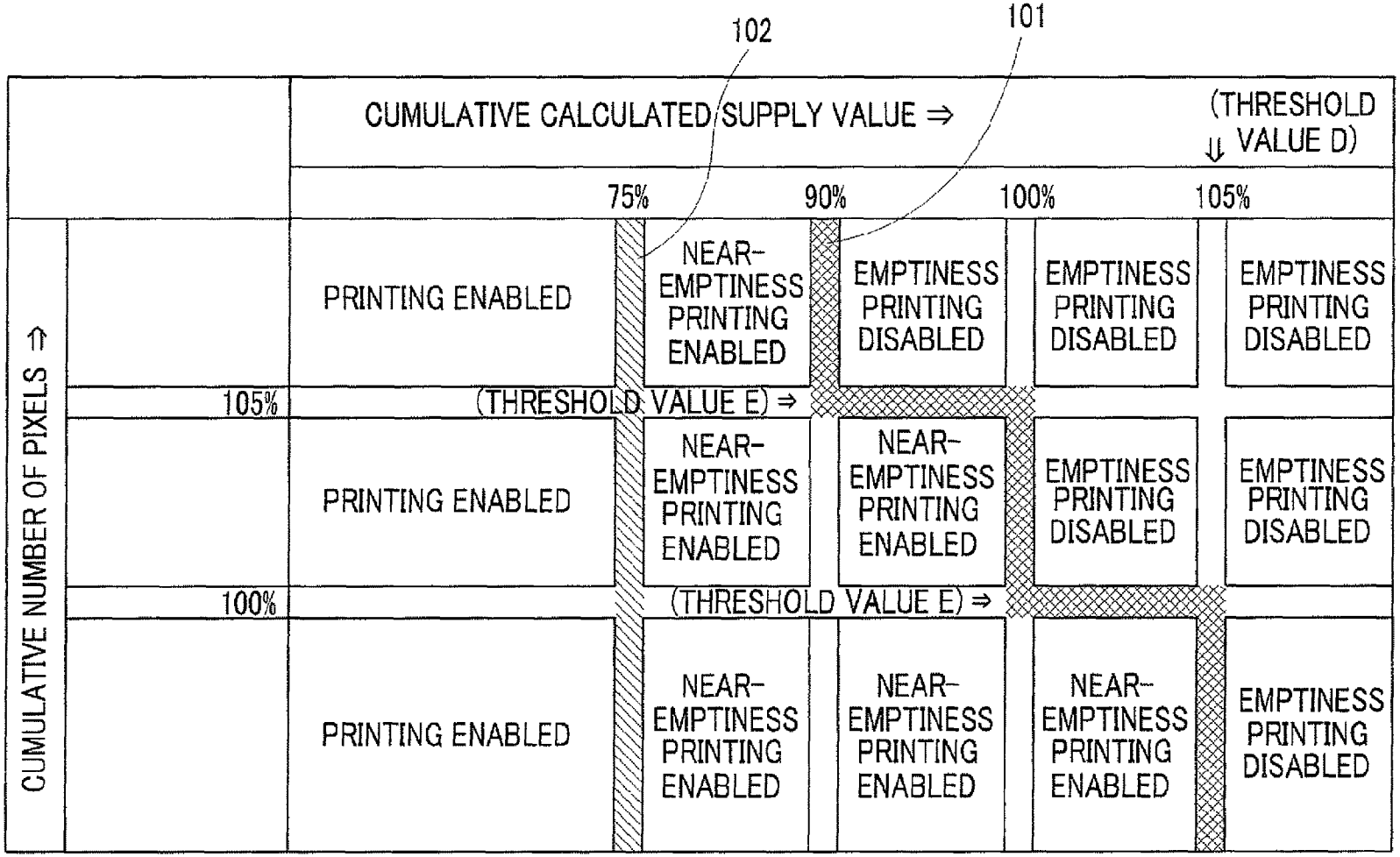
FIG. 8 is a diagram illustrating a lifespan determining algorithm for a memory-attached toner container.

FIG. 8 is a diagram illustrating the algorithm of determining the lifespan of the memory-attached toner container.

In FIG. 8, the cumulative number of pixels 100% and the cumulative calculated supply value 100% are the cumulative number of pixels and the cumulative calculated supply value which may be considered as the lifespan of the toner container when images with the standard image density are continuously printed under the standard operation conditions. Accordingly, since the operation conditions are actually changed variously and the image densities of images to be printed are changed variously, the lifespan may expire even with the cumulative number of pixels or the cumulative calculated supply value less than 100% or the lifespan may not expire even with the cumulative number of pixels or the cumulative calculated supply value more than 100%. In FIG. 8, when the cumulative number of pixels and the cumulative calculated supply value are combined, the left side or lower side of a polygonal line 101 indicates an area where the lifespan does not expire and the right side or the upper side of the polygonal line 101 indicates an area where the lifespan expires.

The line 102 where the cumulative calculated supply value is 75% means a line where it is notified a user that the expiration of the lifespan comes near when the line 102 is reached, although not shown in the flowchart of FIGS. 6 and 7.

The processes of steps S35 and S36 in the flowchart shown in FIG. 7 will be described on the basis of the description with reference to FIG. 8.

In step S35, the cumulative calculated supply value is read from the nonvolatile memory attached to the mounted memory-attached toner container and it is determined whether the cumulative calculated supply value is less than a threshold value D. Here, the cumulative calculated supply value 105% is employed as the threshold value D as shown in FIG. 8. When the cumulative calculated supply value reaches the threshold value D, it is in an area where the printing operation is not enabled regardless of the cumulative number of pixels, thus the message urging a user to replace a toner container is displayed in step S37, and the printing operation is inhibited (step S38).

When it is determined in step S35 that the cumulative calculated supply value is less than the threshold value D (105%), the process of step S36 is performed. In step S36, it is determined whether the cumulative number of pixels is less than a threshold value E defined on the basis of the present cumulative calculated supply value. Specifically, as shown in FIG. 8, when the cumulative calculated supply value is in the range of 90% to 100%, the cumulative number of pixels 105% is employed as the threshold value E and it is determined whether the present cumulative number of pixels is less than the threshold value E (105%). When the cumulative calculated supply value is in the range of 100% to 105%, the cumulative number of pixels 100% is employed as the threshold value E and it is determined whether the present cumulative number of pixels is less than the threshold value E (100%).

When it is determined in step S36 that the cumulative number of pixels reaches the threshold value E defined in this way, the message urging a user to replace a toner container is displayed in step S37 and the printing operation is inhibited (step S38).

On the other hand, when it is determined in step S37 that the cumulative number of pixels is less than the threshold value E, the presently-mounted memory-attached toner container does not expire yet and the printing operation corresponding to one page is performed in step S24.

As described above, in this exemplary embodiment, the printing operation is performed for the bundled toner container not having a nonvolatile memory attached thereto and the lifespan thereof is determined on the basis of the cumulative number of pixels. Regarding the memory-attached toner container, the lifespan thereof is determined with higher precision on the basis of both the cumulative number of pixels and the cumulative calculated supply value.

Here, in this exemplary embodiment, it is determined using the process control whether the toner of the developer in the developing device is insufficient. However, in terms of the lifespan of the toner container, a sensor sensing the toner concentration may be provided to the inside of the developing device and it may be determined whether the toner of the developer in the developing device is insufficient on the basis of the signal from the sensor, instead of the process control.

The emptiness is not limited to the state where the toner in the toner container is actually consumed up.

In the exemplary embodiment, a toner container not having a nonvolatile memory attached thereto is allowed to be used as only the toner container to be first used, but toner containers to be second used may be replaced with any of a toner container not having a nonvolatile memory attached thereto and a toner container having a nonvolatile memory attached thereto. In this case, the lifespan of the toner container not having a nonvolatile memory attached thereto may be determined on the basis of only the cumulative number of pixels and the lifespan of the toner container having a nonvolatile memory attached thereto may be determined on the basis of both the cumulative number of pixels and the cumulative calculated supply value.

A nonvolatile memory may be disposed in the body of the copying machine 1 or the image forming section 1B instead of the toner container, a toner container not having a nonvolatile memory attached thereto may be allowed to be mounted thereon, the lifespan may be determined on the basis of both the cumulative number of pixels and the cumulative calculated supply value using the nonvolatile memory in the body when the apparatus is notified that a user responsibly mounts the toner container on the apparatus, and the lifespan may be determined on the basis of only the cumulative number of pixels when the user's responsible notification may not be confirmed.

Although it has been described that the invention is applied to the copying machine 1 shown in FIG. 1, the invention is not limited to the copying machine but may be applied to various types of apparatuses having an image forming function, such as a printer or facsimile.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member that holds a latent image formed by exposure and that holds a toner image formed by development with toner;

an exposing device that receives image data and that exposes the image holding member on the basis of the image data to form a latent image on the image holding member;

a developing device that develops the latent image on the image holding member with toner to form a toner image on the image holding member;

a transfer device that transfers the toner image on the image holding member to a recording medium;

a fixing device that fixes the transferred toner image to the recording medium;

a container mounting portion that is demountably mounted with a toner container containing toner;

a toner supply unit that supplies the toner to the developing device from the toner container mounted on the container mounting portion;

a first estimation unit that estimates an amount of toner used on the basis of the image data;

a second estimation unit that estimates the amount of toner used on the basis of a toner supplying operation of the toner supply unit; and an emptiness determining unit that determines emptiness of the toner container mounted on the container mounting portion on the basis of only the amount of toner used estimated by the first estimation unit in a first state where it is unclear that the toner container is mounted on the container mounting portion and that determines the emptiness of the toner container mounted on the container mounting portion on the basis of both the amount of toner used estimated by the first estimation unit and the amount of toner used estimated by the second estimation unit in a second state where it is clear that the toner container is mounted on the container mounting portion.

2. The image forming apparatus according to claim 1, wherein the container mounting portion is mounted with both of a toner container having a memory attached thereto and a toner container not having a memory attached thereto, and the image forming apparatus further comprises a control unit that permits an image forming operation in the first state until the cumulative amount of toner used estimated by the first estimation unit reaches a threshold value with which it is determined that the toner container first mounted on the container mounting portion at the time of starting use of the image forming apparatus is empty, and that permits the image forming operation only in a state where the control unit successfully communicates with the memory of the toner container mounted on the container mounting portion and the emptiness determining unit determines that the toner container is not empty after the cumulative amount of toner used reaches the threshold value.

3. The image forming apparatus according to claim 1, further comprising:

an emptiness detecting unit that detects the toner emptiness of the developing device, wherein the emptiness determining unit is notified that the emptiness detecting unit detects the toner emptiness of the developing device and the toner emptiness of the developing device is not solved even by the toner supplying operation of the toner supply unit when the image forming apparatus is in the first state, and determines one of a state where the toner container is not mounted on the container mounting portion and a state where the toner container mounted on the container mounting portion is empty.

4. The image forming apparatus according to claim 2, further comprising:

an emptiness detecting unit that detects the toner emptiness of the developing device, wherein the emptiness determining unit is notified that the emptiness detecting unit detects the toner emptiness of the developing device and the toner emptiness of the developing device is not solved even by the toner supplying operation of the toner supply unit when the image forming apparatus is in the first state, and determines one of a state where the toner container is not mounted on the container mounting portion and a state where the toner container mounted on the container mounting portion is empty.

* * * * *